US009376791B2

(12) United States Patent
Wilkerson et al.

(10) Patent No.: US 9,376,791 B2
(45) Date of Patent: Jun. 28, 2016

(54) FAUCET ASSEMBLIES

(71) Applicants: Randy F. Wilkerson, West Monroe, LA (US); Ricky D. Smith, West Monroe, LA (US)

(72) Inventors: Randy F. Wilkerson, West Monroe, LA (US); Ricky D. Smith, West Monroe, LA (US)

( * ) Notice: Subject to any disclaimer, the term of this patent is extended or adjusted under 35 U.S.C. 154(b) by 828 days.

(21) Appl. No.: 13/622,561

(22) Filed: Sep. 19, 2012

(65) Prior Publication Data

US 2014/0174579 A1 Jun. 26, 2014

(51) Int. Cl.
*E03C 1/042* (2006.01)
*E03C 1/04* (2006.01)

(52) U.S. Cl.
CPC ..... *E03C 1/0401* (2013.01); *Y10T 137/9464* (2015.04)

(58) Field of Classification Search
CPC ..... E03C 1/00; E03C 1/021; E03C 1/04; E03C 1/0401–1/0412; E03C 1/042; E03C 2001/028; E03C 2001/0414–2001/0418; E03C 2201/50
USPC ..... 137/15.01, 15.08, 15.18, 359, 606, 798, 137/801; 4/643, 671–678, 695–696
See application file for complete search history.

(56) References Cited

U.S. PATENT DOCUMENTS 3,181,895 A * 5/1965 Cator ..... F16L 37/004 285/1
3,448,768 A * 6/1969 Keller ..... F16K 19/006 118/621
4,262,699 A 4/1981 Fabian
4,848,395 A 7/1989 Krippendorf
5,535,776 A 7/1996 Kingman
5,865,477 A 2/1999 Ko
5,950,663 A * 9/1999 Bloomfield ..... E03C 1/0403 137/359
5,983,917 A 11/1999 Thomas
6,684,906 B2 * 2/2004 Burns ..... E03C 1/0403 137/606
6,807,692 B2 * 10/2004 Tsutsui ..... E03C 1/0401 137/359
7,207,075 B2 * 4/2007 Peterson ..... E03C 1/0404 285/368
7,269,864 B2 9/2007 Brown et al.
7,698,755 B2 4/2010 McNerney et al.
7,753,079 B2 * 7/2010 Nelson ..... E03C 1/0404 137/801
7,832,428 B2 * 11/2010 Leutwyler ..... E03C 1/0401 137/801
2011/0100478 A1 * 5/2011 Allen ..... F16K 31/602 137/15.01
2011/0100484 A1 * 5/2011 Allen ..... E03C 1/023 137/359

* cited by examiner

*Primary Examiner* — Kevin P Shaver
*Assistant Examiner* — Nicholas Ros
(74) *Attorney, Agent, or Firm* — R. Keith Harrison

(57) ABSTRACT

In an illustrative embodiment, a faucet assembly includes a faucet housing; a faucet spout carried by the faucet housing; at least one water valve disposed in fluid communication with the faucet spout; at least one delivery conduit disposed in fluid communication with the at least one water valve; and at least one magnetic faucet mount assembly including at least one faucet housing connector element carried by the faucet housing and at least one sink connector element adapted for engaging the sink, the at least one faucet housing connector element and the at least one sink connector element magnetically engaging each other.

13 Claims, 9 Drawing Sheets

FAUCET ASSEMBLIES

CROSS-REFERENCE TO BELATED APPLICATIONS

This application claims the benefit of U.S. provisional application No. 61/626,944, filed Sep. 19, 2011 and entitled FAUCET ASSEMBLY, which provisional application is incorporated by reference herein in its entirety.

FIELD

The disclosure generally relates to faucets. More particularly, the disclosure relates to faucet assemblies which can be easily and expeditiously installed on a sink.

BACKGROUND

Many conventional faucets include a generally elongated faucet plate, a spout which extends from the middle of the faucet plate and separate cold and hot water valves that are fitted with respective valve handles and disposed in fluid communication with the spout. A sink to which the faucet is attached includes preformed cold and hot water openings. In installation of the faucet on the sink, the cold water valve is extended through the cold water opening and the hot water valve is extended through the hot water opening in the sink. Cold and hot water delivery conduits are typically threadably attached to the respective cold and hot water valves. The cold and hot water delivery conduits extend beneath the sink and connect to cold and hot water supplies, respectively.

One of the drawbacks of installing a conventional faucet on a sink is that the cold and hot water delivery conduits are typically connected to the cold and hot water valves, respectively, beneath the sink. This operation is cumbersome for the installer since the area beneath the sink is dark and confining and therefore, is not easily conducive to attaching the cold and hot water delivery conduits to the respective valves.

Accordingly, faucet assemblies which can be easily and expeditiously installed, on a sink by facilitating, attachment of cold and hot water delivery conduits to the respective cold and hot water valves of the faucet above the sink may be desirable for some applications.

SUMMARY

Illustrative embodiments of the disclosure are generally directed to faucet assemblies for attachment to a sink. An illustrative embodiment of the faucet assembly includes a faucet housing; a faucet spout carried by the faucet housing, at least one water valve disposed in fluid communication with the faucet spout; at least one delivery conduit disposed in fluid communication with the at least one water valve; and at least one magnetic faucet mount assembly including at least one faucet housing connector element carried by the faucet housing and at least one sink connector element adapted for attachment to the sink, the at least one faucet housing connector element and the at least one sink connector element magnetically engaging each other.

BRIEF DESCRIPTION OF THE DRAWINGS

Illustrative embodiments of the disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. Relative terms such as "top", "bottom" and "side" are used for descriptive purposes herein and indicate the positions of the various components of the assembly relative to the corresponding are not intended to be construed in a limiting sense as the faucet assembly may be used in alternative applications in which such relative terms do not apply.

Figure 1:
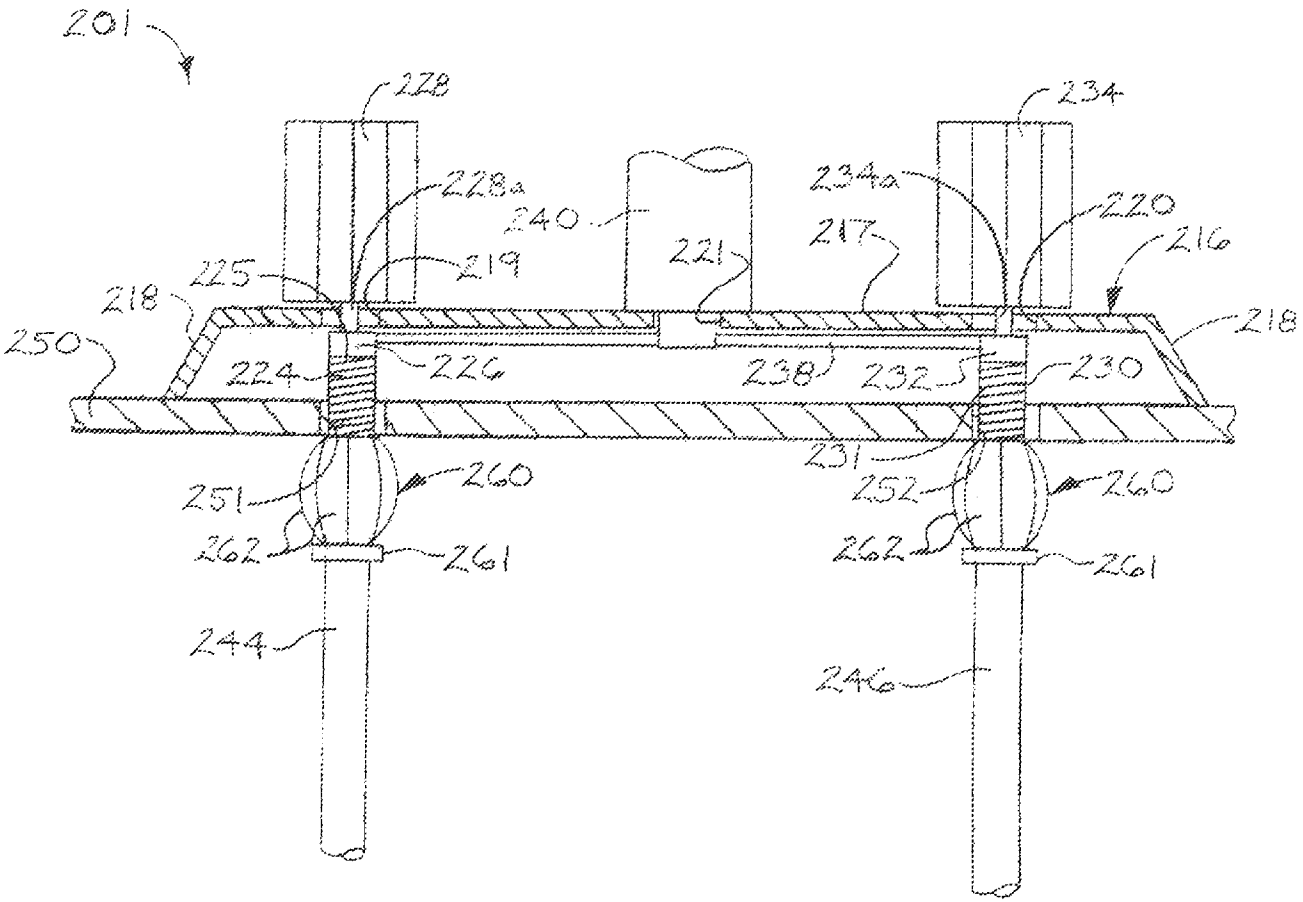
FIG. 1 is a longitudinal sectional view of an illustrative embodiment of the faucet assemblies, mounted in place on a sink (also shown in section)

Referring initially to FIG. 1 of the drawings, an illustrative embodiment of the faucet assembly is generally indicated by reference numeral 201. The faucet assembly 201 may include a faucet housing 216 which is adapted for attachment to a sink 250 as will be hereinafter described. The faucet housing 216 may include a housing top 217 and housing sides 218 which angle from the housing top 217. A cold water handle opening 219 and a hot water handle opening 220 may extend through the housing top 217 of the faucet housing 216. A bearing (not illustrated) may extend through each of the cold water handle opening 219 and the hot water handle opening 220. A faucet opening 221 may extend through the housing top 217 of the faucet housing 216 between the cold water handle opening 219 and the hot water handle opening 220.

A cold water valve handle 228 may include a valve handle shaft 228*a* which extends through the cold water handle opening 219 in the housing top 217 of the faucet housing 216. The valve handle shaft 228*a* may operably engage a cold water valve 226. In like manner, a hot water valve handle 234 may include a valve handle shaft 234*a* which extends through the hot water handle opening 220 in the housing top 217 of the faucet housing 216 and operably engages a hot water valve 232. A faucet spout 240 (partially in section) may extend upwardly from the housing top 217 of the faucet housing 216 between the cold water valve handle 228 and the hot water valve handle 234. The faucet spout 240 may be disposed in fluid communication with the cold water valve 226 and the hot water valve 232 through a corresponding connecting conduit 238.

A cold water valve conduit 224 having exterior conduit threads 225 may be disposed in fluid communication with the cold water valve 226. A cold water delivery conduit 244 may be threadably attached to the conduit threads 225 on the cold water valve conduit 224. A cold water source (not illustrated) may be disposed in fluid communication with the cold water delivery conduit 244 beneath the sink 250. A hot water valve conduit 230 having exterior conduit threads 231 may be disposed in fluid communication with the hot water valve 232. A hot water delivery conduit 246 may be threadably attached to the conduit threads 231 on the hot water valve conduit 230. A hot water source (not illustrated) may be disposed in fluid communication with the hot water delivery conduit 246 beneath the sink 250.

A retainer nut 260 may be placed on each of the cold water delivery conduit 244 and the hot water delivery conduit 246. Each retainer nut 260 may include a nut base 261 which threadably engages the corresponding cold water delivery conduit 244 or hot water delivery conduit 246. Multiple, flexible nut bands 262 may how outwardly from the nut base 261. Accordingly, each retainer nut 260 engages the lower surface of the sink 250 and retains the faucet housing 216 on the sink 250. In some embodiments, each retainer nut 260 may be interiorly-threaded to engage the exterior conduit threads 225 on the cold water valve conduit 224 and the exterior conduit threads 231 on the hot water valve conduit 230.

In installation of the faucet assembly 201 on the sink 250, the cold water delivery conduit 244 and the hot water delivery conduit 246 are initially extended upwardly through a cold water opening 251 and a hot water opening 252, respectively, in the sink 250. The retainer nuts 260 are threaded on the respective cold water valve conduit 224 and hot water valve conduit 230 above the sink 250. Next, as the faucet housing 216 is lowered in place on the sink 250, the retainer nuts 260 are inserted downwardly through the respective cold water opening 251 and hot water opening 252 in the sink 250. Constrained by the relatively smaller circumference of corresponding cold water opening 251 and hot water opening 252, the nut bands 262 are deformed inwardly and then expand back outwardly as each retainer nut 260 emerges from the corresponding cold water opening 251 and hot water opening 252 beneath the sink 250. Therefore, the retainer nuts 260 secure the faucet plate housing 16 to the sink 250. In some applications, caulk (not illustrated) may be applied around the perimeter of the housing sides 218 of the faucet housing 216 for sealing purposes as is known by those skilled in the art. The faucet assembly 201 can be selectively detached from the sink 250 by reversing the steps set forth above.

Figure 2:
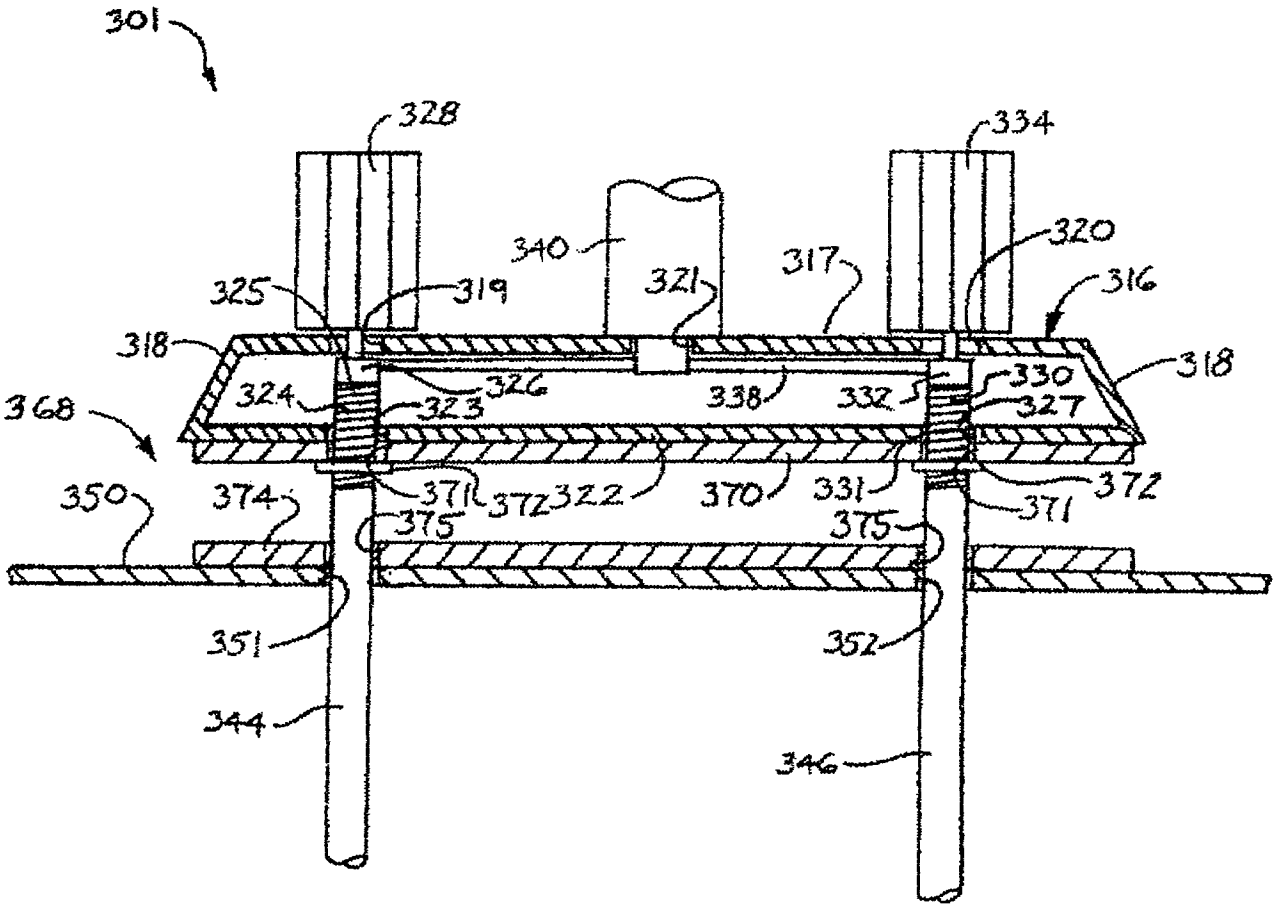
FIG. 2 is an exploded longitudinal sectional view of another illustrative embodiment of the faucet assemblies.
Figure 3:
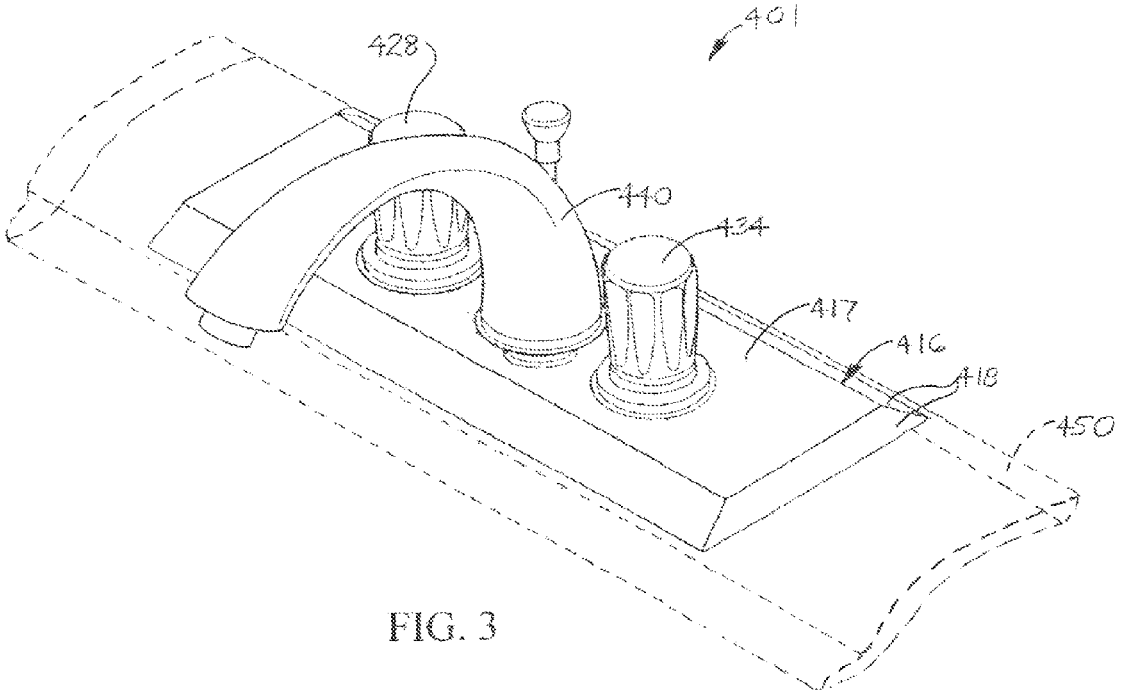
FIG. 3 is a perspective view of another alternative illustrative embodiment of the faucet assemblies.

Referring next to FIG. 2 of the drawings, another alternative illustrative embodiment of the faucet assembly is generally indicated by reference numeral 301. The faucet assembly 301 may be similar in design to the faucet assembly 1 which was heretofore described with respect to FIG. 1, with like numerals in the 301 series of the faucet assembly 301 designating corresponding components indicated by like numerals in the series 201-299 of the faucet assembly 201. The faucet housing 316 of the faucet assembly 301 may include a housing bottom 322 which is provided on the housing sides 318 and spaced-apart from the housing top 317. At least one magnetic faucet assembly 368 facilitates attachment of the faucet housing 316 to a sink 350 as will be hereinafter described. The magnetic faucet mount assembly 368 may include at least one faucet housing connector element 370 provided on the bottom surface of the housing bottom 322. In some embodiments, the faucet housing connector element 370 may be secured on the housing bottom 322 using adhesives (not illustrated), mechanical fasteners not illustrated) and/or any other suitable technique which is known by those skilled in the art. At least one sink connector element 374 may be provided on the upper surface of the sink 350. The faucet housing connector element 370 and the sink connector element 374 are magnetically attracted to each other. Accordingly, the faucet housing connector element 370 is adapted to magnetically engage the sink connector element 374 to detachably and yet securely attach the faucet housing 316 to the sink 350. In some embodiments, each of the faucet housing connector element 370 and the sink connector element 374 may be an elongated bar or plate.

In typical installation of the faucet assembly 301 on the sink 350, the cold water delivery conduit 344 and the hot water delivery conduit 346 are initially extended upwardly through the cold water opening 351 and the hot water opening 352, respectively, in the sink 350 and then through the registering conduit openings 375 in the sink connector element 374. The retainer nuts 372 are threaded on the respective cold water valve conduit 324 and hot water valve conduit 330 above the sink 350. The cold water valve conduit 324 is extended through a conduit opening 371 in the faucet housing connector element 370 and through a registering conduit opening 323 in the housing bottom 322 of the faucet housing 316 and then coupled to the cold water valve 326. In like manner, the hot water valve conduit 330 is extended through a conduit opening 371 in the faucet housing connector element 370 and through a registering conduit opening 327 in the housing bottom 322 of the faucet housing 316 and then coupled to the hot water valve 332. The retainer nuts 372 are then threaded on the respective cold water valve conduit 324 and hot water valve conduit 330, respectively, and tightened against the bottom surface of the faucet housing connector element 370.

Next, the faucet plate housing 316 is lowered to rest on the sink 350 such that the faucet housing connector element 370 is magnetically attached to the sink connector element 374. Accordingly, the sink connector element 374 and the faucet housing connector element 370 secure the faucet plate housing 316 in place on the sink 350. The faucet assembly 301 may then be operated in the conventional manner. The faucet assembly 301 can be selectively detached from the sink 350 by reversing the steps set forth above.

Figure 4:
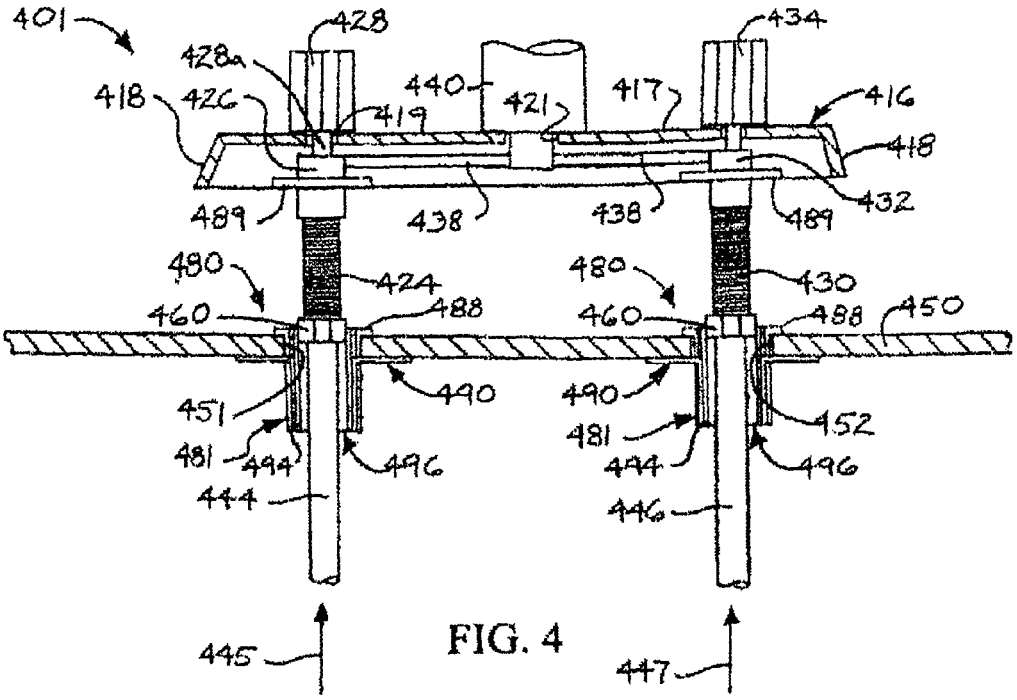
FIGS. 4 and 5 are sectional views illustrating sequential installation of the illustrative embodiment of the faucet assemblies illustrated in FIG. 3 on a sink.
Figure 5:
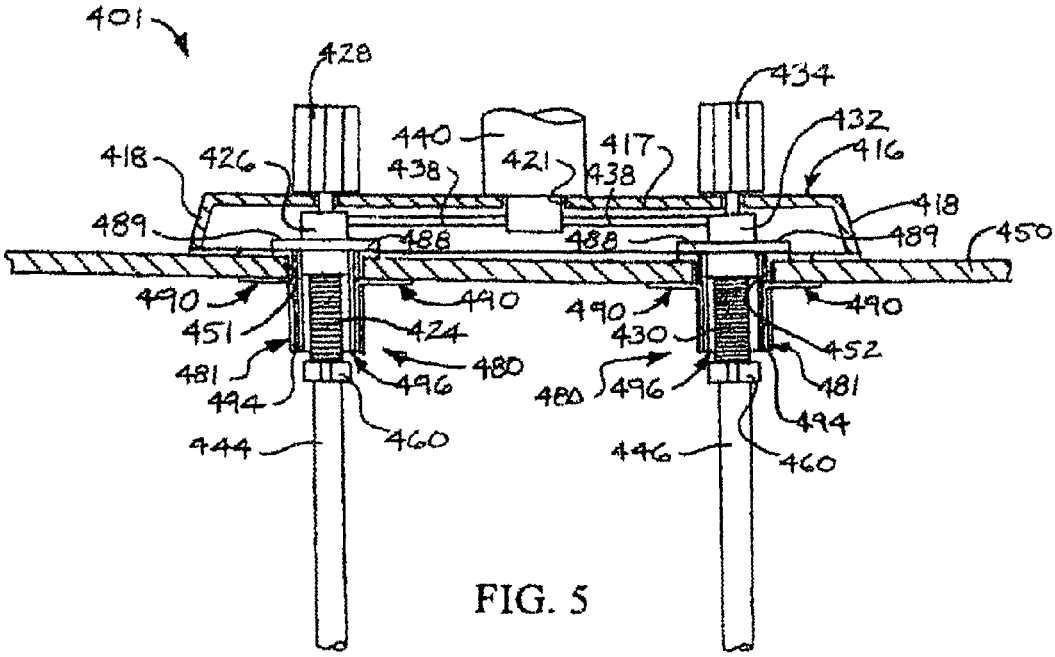
Figure 6:
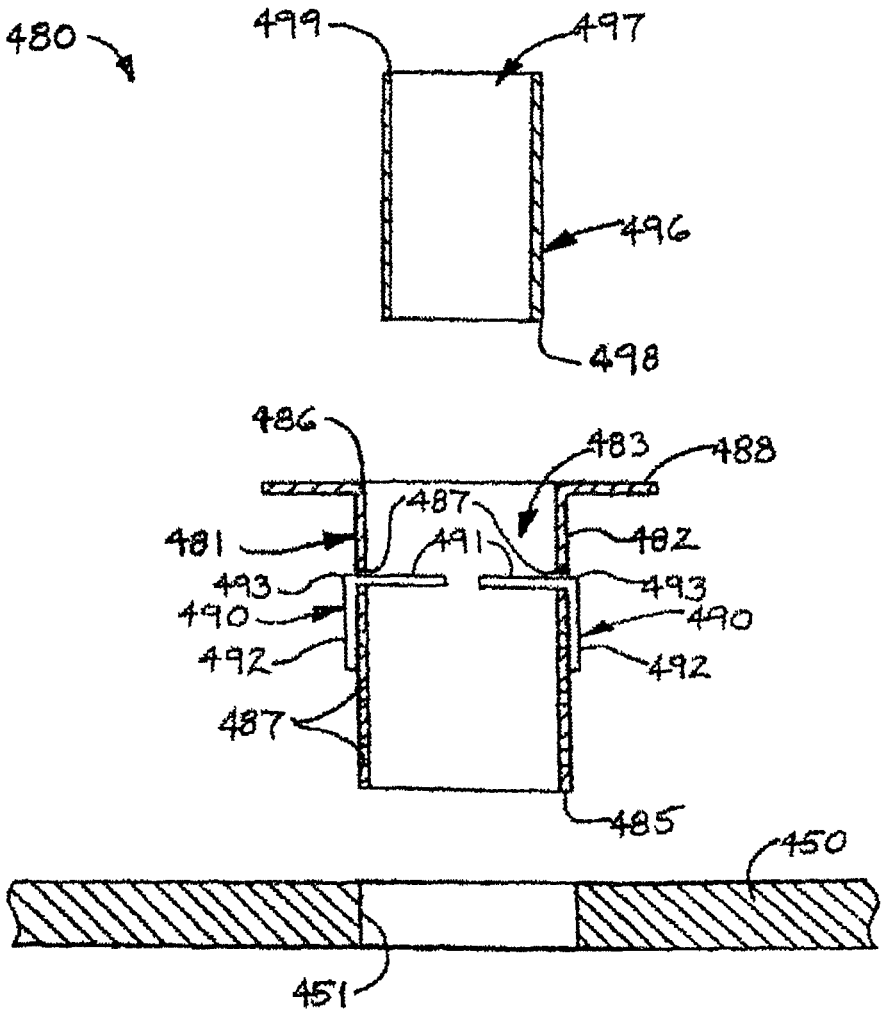
FIGS. 6-8 are exploded sectional views illustrating exemplary installation of a magnetic faucet mount assembly in a cold water opening of a sink preparatory to installation of the illustrative embodiment of the faucet assemblies illustrated in FIG. 3 on the sink.
Figure 7:
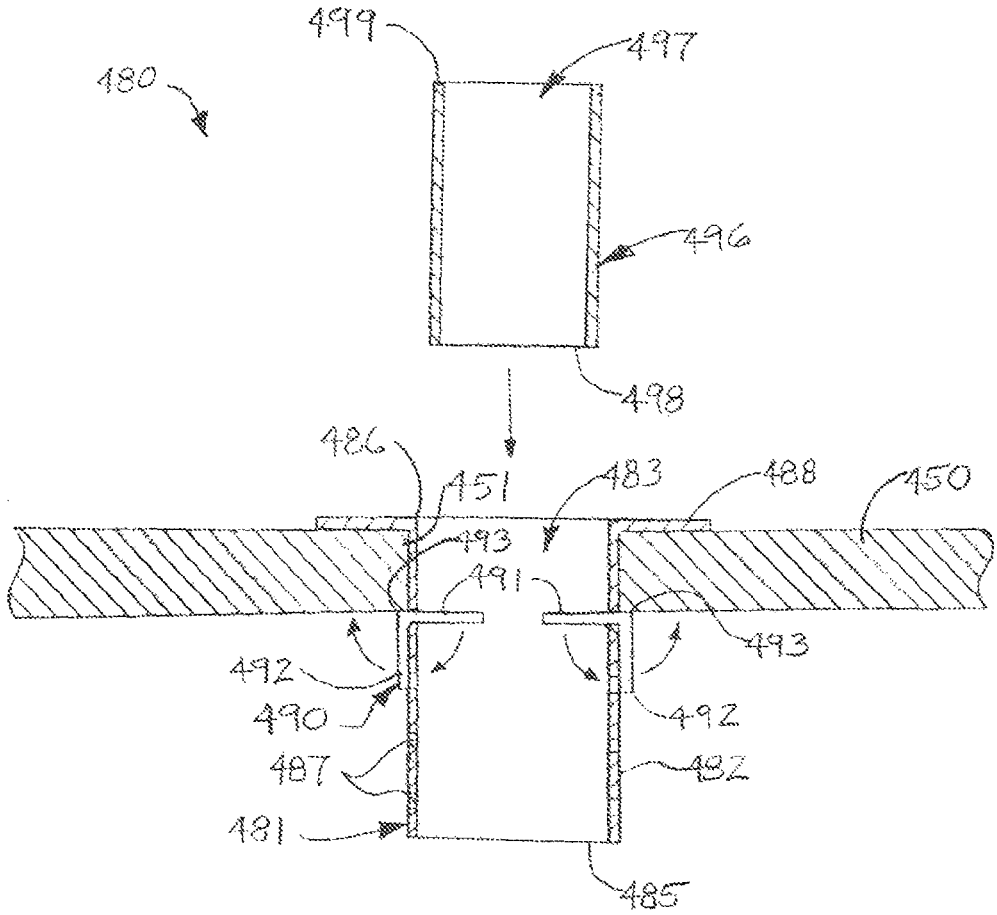
Figure 8:
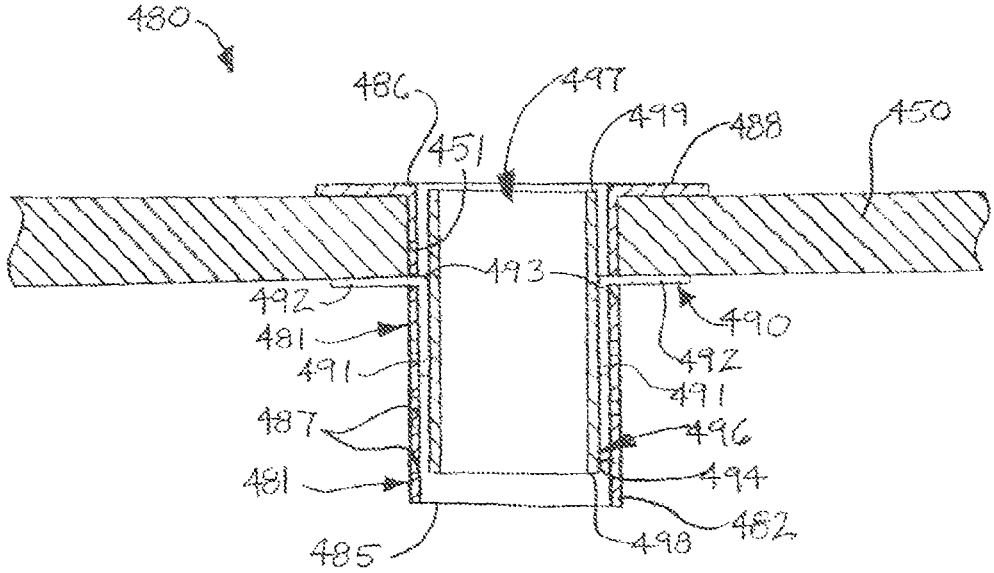

Referring next to FIGS. 3-9 of the drawings, another alternative illustrative embodiment of the faucet assembly is generally indicated by reference numeral 401. The faucet assembly 401 may be similar in design to the faucet assembly 201 which was heretofore described with respect to FIG. 1, with like numerals in the 401-499 series of the faucet assembly 101 designating corresponding components indicated by like numerals in the series 201-299 of the faucet assembly 201. As illustrated in FIGS. 3-9, the faucet assembly 401 may include a faucet housing 416. At least one magnetic faucet mount assembly 480 facilitates attachment of the faucet housing 416 to a sink 450 as will be hereinafter described. As illustrated in FIGS. 6-8, each faucet mount assembly 480 may include an assembly base 481. The assembly base 481 may include a generally elongated, cylindrical assembly base housing 482 having a bottom housing end 485 and a top housing end 486. A housing interior 483 extends through the assembly base housing 482 from the bottom housing end 485 to the top housing end 486. At least one pair of spaced-apart pin openings 487 may extend through the wall of the assembly base housing 482 typically in diametrically-opposed relationship to each other. In some embodiments, multiple spaced-apart pairs of pin openings 487 may extend through the wall of the assembly base housing 482 in spaced-apart relationship to each other along the length of the assembly base housing 482 between the bottom housing end 485 and the top housing end 486. An annular sink connector elementsink connector element 488 may extend outwardly from the top housing end 486 of the assembly base housing 482. As illustrated in FIGS. 4 and 5, a faucet housing connector elementfaucet housing connector element 489 is provided on each of the cold water valve 426 and the hot water valve 432 in the faucet housing 416. At least one of each sink connector elementsink connector element 488 and each faucet housing connector elementfaucet housing connector element 489 is a magnetic material. Thus, each sink connector elementsink connector element 488 is adapted to magnetically engage each corresponding faucet housing connector elementfaucet housing connector element 489 to mount the faucet housing 416 on the sink 450, as will be hereinafter described. In some embodiments, each of the faucet housing connector element 489 and the sink connector element 488 may be generally disc-shaped or annular.

At least one assembly base retainer pin 490 extends through at least one of the pin openings 487 in the assembly base housing 482. Each assembly base retainer pin 490 is pivotally mounted in the corresponding pin opening 487 and may include an inside pin arm 491 which is disposed in the housing interior 483 of the assembly base housing 482. An outside pin arm 492 extends from the inside pin arm 491 at a pin arm junction 493 and is disposed outside the housing interior 483 of the assembly base housing 482. Each assembly base retainer pin 490 may be pivotal between a release position illustrated in FIGS. 6 and 7 and a locking position illustrated in FIG. 8. In the release position of each assembly base retainer pin 490, the inside pin arm 491 is oriented perpendicular to the interior surface of the assembly base housing 482 whereas the outside pin arm 492 is oriented parallel to and against the exterior surface of the assembly base housing 482. In the locking position of the assembly base retainer pin 490, the inside pin arm 491 is oriented parallel to and against the interior surface of the assembly base housing 482 and the outside pin arm 492 is oriented perpendicular to the exterior surface of the assembly base housing 482. The purpose of the assembly base retainer pins 490 will be hereinafter described.

In mounting at the faucet housing 416 on the sink 450, which will be hereinafter further described, the assembly base housing 482 of each of a pair of the assembly bases 481 is inserted downwardly through the corresponding cold water opening 451 and hot water opening 452 until the sink connector elementsink connector element 488 rests on the sink 450. The assembly base retainer pins 490 are initially deployed in the release position illustrated in FIG. 7. A pin locking mechanism 496 may secure the assembly base retainer pins 490 in the locking position. In some embodiments, the pin locking mechanism 496 may include an assembly retaining sleeve 496 which is inserted downwardly into the housing interior 483 of the assembly base 481. The assembly retaining sleeve 496 may be generally elongated and cylindrical with a bottom sleeve end 498 and a top sleeve end 499. A sleeve interior 497 extends through the assembly retaining sleeve 496 from the bottom sleeve end 498 and the top sleeve end 499. In alternative embodiments, the pin locking mechanism may be any type of mechanism which is suitable for securing the assembly base retainer pins 490 in the locking position according to the knowledge of those skilled in the art.

As illustrated in FIGS. 7 and 8, as the assembly retaining sleeve 496 is inserted downwardly through the housing interior 483 of the assembly base housing 482, the bottom sleeve end 498 pushes the inside pin arms 491 of the respective assembly base retainer pins 490 downwardly in the sleeve interior 497. This action pivots the assembly base retainer pins 490 at the pin arm junctions 493 in the respective pin openings 487 from the release position (FIGS. 6 and 7) to the locking position FIG. 8). An annular spec 494 is defined between the interior surface of the assembly base housing 482 and the exterior surface of the assembly retaining sleeve 496. The inside pin arm 491 of each assembly base retainer pins 490 is sandwiched between the assembly base housing 482 and the assembly retaining sleeve 496 whereas the outside pin arm 492 of each assembly base retainer pin 490 engages the lower surface of the sink 450. Therefore, the outside pin arms 492 of the respective assembly base retainer pins 490 lock the assembly base 481 in the corresponding cold water opening 451 and hot water opening 452. The assembly retaining sleeve 496 remains in place in each corresponding assembly base 481 during subsequent installation of the faucet housing 416 on the sink 450.

Figure 9:
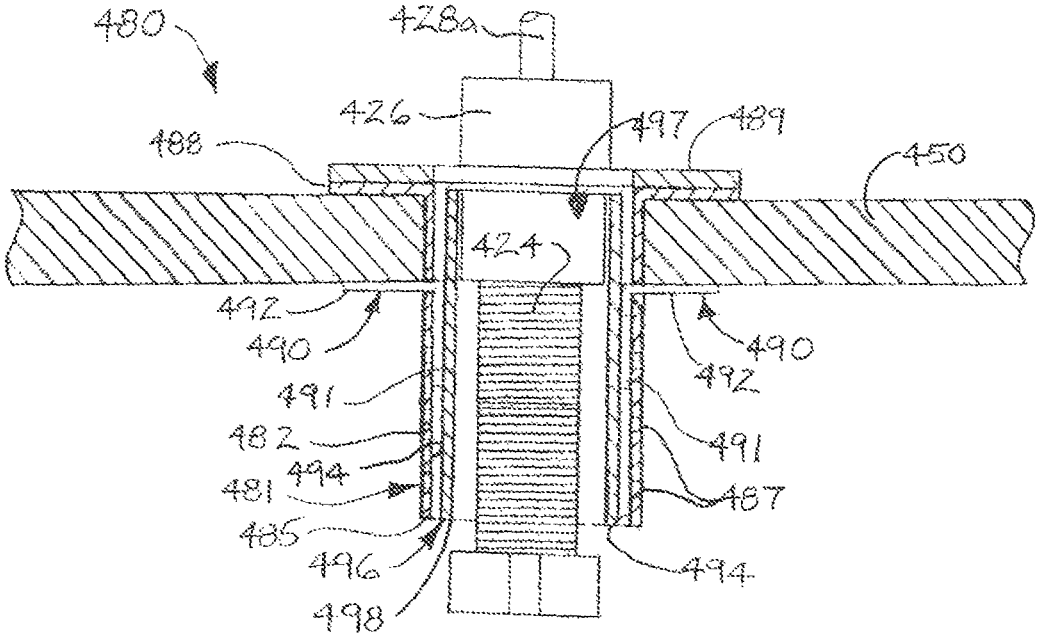
FIG. 9 is a sectional view of the magnetic faucet mount assembly in place in the cold water opening in the sink with the cold water valve conduit extending through the magnetic faucet mount assembly.

In installation of the faucet assembly 401 on the sink 450, the assembly bases 481 are initially mounted in the respective cold water opening 451 and hot water opening 452 in the sink 450 as was heretofore described with respect to FIGS. 6-8. The cold water delivery conduit 444 and the hot water delivery conduit 446 are extended upwardly through the sleeve interiors 497 in the respective assembly retaining sleeves 496 of the respective magnetic faucet mount assemblies 480. The retainer nuts 460 are threaded on the respective cold water valve conduit 424 and hot water valve conduit 430 above the sink 450. As the faucet housing 416 is next lowered in place on the sink 450, the faucet housing connector elements 489 magnetically engage the respective sink connector elements 488 of the magnetic faucet mount assemblies 480, as illustrated in FIGS. 5 and 9. Therefore, the magnetic attraction between the sink connector elements 488 and the respective faucet housing connector elements 489 secures the faucet plate housing 416 to the sink 450. In some applications, caulk (not illustrated) may be applied around the perimeter of the housing sides 418 of the faucet housing 416 for sealing purposes as is known by those skilled in the art. The faucet assembly 401 can be selectively detached from the sink 450 by reversing the steps set forth above.

It will be appreciated by those skilled in the art that the pin openings 487 through which the assembly base retainer pins 490 are extended can be selected depending on the thickness of the sink 450 to which the assembly base 481 is to be attached. Therefore, in the case of a thinner sink 450, the assembly base retainer pin or pins 490 may be extended through one or more of the pin openings 487 which are located closer to the to housing end 486 than the bottom housing end 485. Conversely, in the case of a thicker sink 450, the assembly base retainer pin or pins 490 may be extended through one or more of the pin openings 487 which are located closer to the bottom housing end 485 than the top housing end 486.

Figure 10:
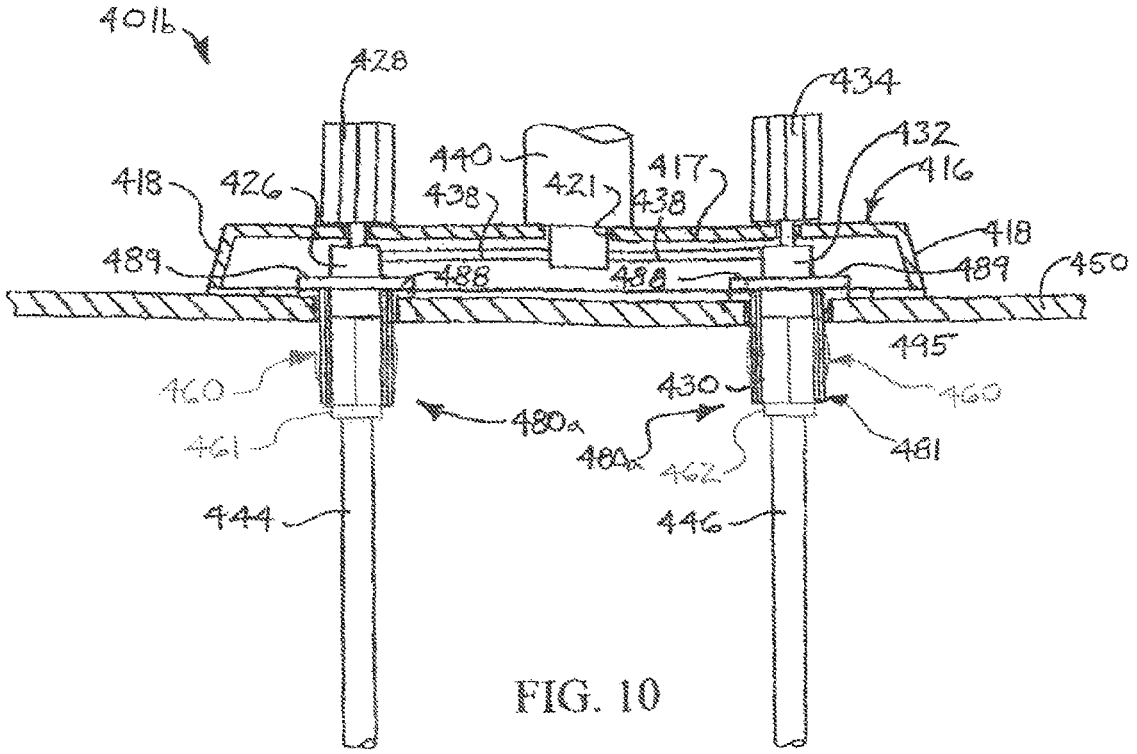
FIG. 10 is a longitudinal sectional view of another alternative illustrative embodiment of the faucet assemblies with an alternative design for the magnetic faucet mount assemblies.
Figure 11:
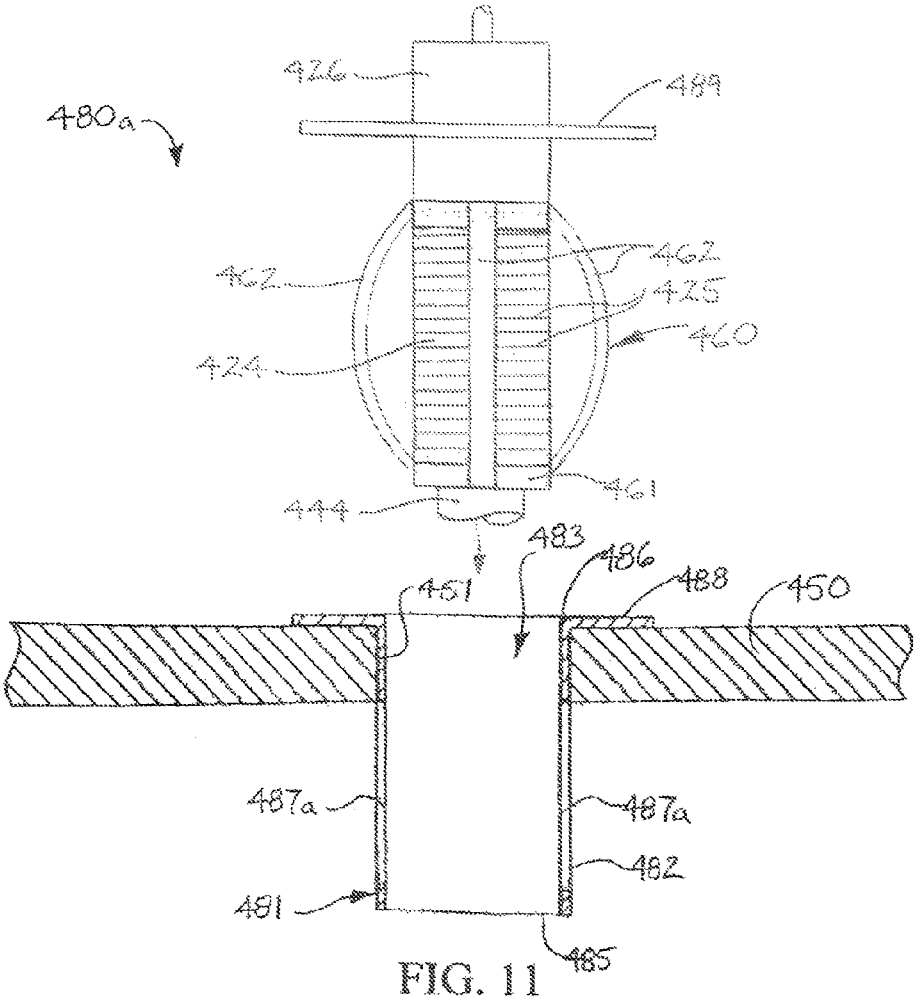
FIGS. 11 and 12 are sectional views illustrating sequential installation of a magnetic faucet mount assembly of the faucet assembly of FIG. 10 in the cold water opening of a sink preparatory to installation of the faucet assembly on the sink.
Figure 12:
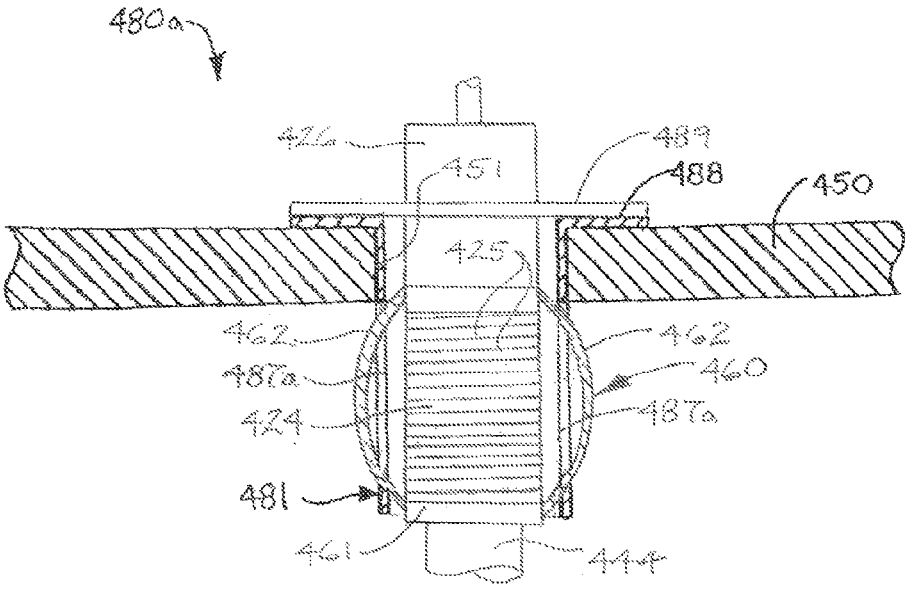

Referring next to FIGS. 10-12 of the drawings, another alternative illustrative embodiment of the faucet assembly 401*b* (FIG. 10) includes a pair of magnetic faucet mount assemblies 480*a*. At least one nut band opening 487*a* (FIG. 11) extends through the wall of the assembly base housing 482 of the assembly base 481. A retainer nut 460 may be placed on each of the cold water delivery conduit 444 and the hot water delivery conduit 446. As illustrated in FIG. 11, each retainer nut 460 may include a nut base 461 which threadably engages exterior conduit threads 425 on the corresponding cold water valve conduit 424 or exterior conduit threads (not illustrated) on the hot water delivery conduit 430. At least one flexible nut band 462 may bow outwardly from the nut base 461. Each nut band 462 may be curved, as illustrated, or angled (not illustrated) in side view.

The assembly base 481 of each magnetic faucet mount assembly 480*a* is secured in the corresponding cold water opening 451 or hot water opening 452 in the sink 450 by initially inserting the assembly base housing 482 through the corresponding cold water opening 451 or hot water opening 452, as illustrated in FIG. 11, until the sink connector element 488 rests on the sink 450. The retainer nut 460 is next retained in the housing interior 483 of the corresponding assembly base 481 by inserting the retainer nut 460 into the housing interior 483 as the interior surface of the assembly base housing 482 deforms the nut bands 462 inwardly and the flexible nut bands 462 subsequently snap out through the respective nut had openings 487*a* in the assembly base housing 482, as illustrated in FIG. 12. At that point, the faucet housing connector element 489 on the cold water valve 426 or hot water valve 432 magnetically engages the corresponding sink connector element 488, securing the faucet housing 416 on the sink 450. The faucet assembly 401*b* can be selectively detached from the sink 450 by reversing the steps set forth above.

While illustrative embodiments of the disclosure have been described above, it will be recognized and understood that various modifications can be made and the appended claims are intended to cover all such modifications which may fall within the spirit and scope of the disclosure.

What is claimed:

1. A faucet assembly for attachment to a sink, comprising:
- a faucet housing;
- a faucet spout carried by the faucet housing;
- at least one water valve disposed in fluid communication with the faucet spout;
- at least one delivery conduit disposed in fluid communication with the at least one water valve; and
- at least one magnetic faucet mount assembly including:
  - at least one faucet housing connector element carried by the faucet housing;
  - an assembly base including an assembly base housing having a non-threaded housing interior, the assembly base housing adapted for insertion through at least one water opening in the sink;
  - at least one sink connector element adapted far engaging the sink, the at least one faucet housing connector element and the at least one sink connector element magnetically engaging each other;
  - at least one pin opening in the assembly base housing;
  - at least one assembly base retainer pin extending through the at least one pin opening, the at least one assembly base retainer pin pivotal between a release position and a locking position; and
  - a pin locking mechanism including an assembly retaining sleeve inserted in the housing interior of the assembly base housing of the assembly base in non-threaded relationship to the assembly base housing, the assembly retaining sleeve engaging and securing the at least one assembly base retainer pin in the locking position.

2. The faucet assembly of claim 1 wherein the at least one assembly base retainer pin comprises an inside pin arm disposed in the housing interior of the assembly base housing and an outside pin arm extending from the inside pin arm and disposed outside the housing interior of the assembly base housing.

3. The faucet assembly of claim 2 wherein the outside pin arm is generally perpendicular to the inside pin arm.

4. The faucet assembly of claim 1 further comprising a pin locking mechanism engaging and securing the at least one assembly base retainer pin in the locking position.

5. The faucet assembly of claim 1 wherein the at least one faucet housing connector element is carried by the at least one water valve.

6. A faucet assembly for attachment to a sinks comprising:
- a faucet housing;
- a faucet spout carried by the faucet housing;
- at least one water valve disposed in fluid communication with the faucet spout;
- at least one delivery conduit disposed in fluid communication with the at least one water valve; and
- at least one magnetic faucet mount assembly including:
  - at least one faucet housing connector element carried by the at least one water valve;
  - an assembly base having an assembly base housing with a first housing end, a second housing end and a non-threaded housing interior and a sink connector element extending outwardly from the assembly base housing at the first housing end, the assembly base housing adapted for insertion through at least one water opening in the sink and the sink connector element adapted for engaging the sink;
  - at least one pin opening in the assembly base housing;
  - at least one assembly base retainer pin extending through the at least one pin opening, the at least one assembly base retainer pin pivotal between a release position and a locking position;
  - the at least one faucet housing connector element and the at least one sink connector element magnetically engaging each other;
  - an assembly retaining sleeve having a sleeve interior inserted through the housing interior in non-threaded relationship to the assembly base housing, the assembly retaining sleeve adapter to pivot the at least one assembly base retainer pin from the release position to the locking position; and
  - an annular space defined between an interior surface of the assembly base housing and an exterior surface of the assembly retaining sleeve from the top housing end to the bottom housing end.

7. The faucet assembly or claim 6 wherein the at least one assembly base retainer pin comprises an inside pin arm disposed in the housing interior or the assembly base housing and an outside pin arm extending from the inside pin arm and disposed outside the housing interior of the assembly base housing.

8. The faucet assembly of claim 7 wherein the outside pin arm is generally perpendicular to the inside pin arm.

9. The faucet assembly or claim 6 further comprising at least one water valve conduit disposed in fluid communication with the at least one water valve and at least one water delivery conduit disposed in fluid communication with the at least one water valve conduit, the at least one water valve conduit disposed in the sleeve interior or the assembly retaining sleeve.

10. A faucet assembly for attachment to a sink, comprising:

a faucet housing;

a faucet spout carried by the faucet housing;

at least one water valve disposed in fluid communication with the faucet spout;

at least one water valve conduit disposed in fluid communication with the at least one water valve;

at least one delivery conduit disposed in fluid communication with the at least one water valve conduit; and at least one magnetic faucet mount assembly each including:

a faucet housing connector element carried by the at least one water valve;

an assembly base having a generally cylindrical assembly his housing with a first housing end, a second housing end, a non-threaded housing interior extending from the first housing end to the second housing end, at least one of pair of spaced-apart pin openings in the assembly base housing and a sink connector element extending outwardly from the first housing end of the assembly base housing, the assembly hale housing adapted for insertion through a water opening in the sink and the sink connector element adapted for engaging the sink;

a plurality of assembly base retainer pins pivotally mounted in the spaced-apart pin openings, respectively, each of the plurality of assembly base retainer pins having an inside pin arm disposed in the housing, interior of the assembly base housing, an outside pin arm disposed outside the housing interior of the assembly base housing and a pin arm junction connecting the inside pin arm to the outside pin arm;

each of the plurality of assembly base retainer pins pivotal between a release position and a locking position;

a pin locking mechanism engaging and securing the assembly base retainer pins in the locking position with the outside pin arm of each of the plurality of assembly base retainer pins positioned to engage the sink, the pin locking mechanism including an assembly retaining sleeve having a sleeve interior inserted into the housing interior of the assembly base housing in non-threaded relationship to the assembly base housing, the assembly retaining sleeve constraining the plurality of assembly base retainer pins in the locking position;

an annular space defined between an interior surface of the assembly base housing and an exterior surface of the assembly retaining sleeve from the top housing end to the bottom housing end, the inside pin arm of each of the plurality of assembly base retainer pins disposed in the annular space when the plurality of assembly base retainer pins are in the locking position; and the faucet housing connector element and the sink connector element adapted to secure the faucet housing to the sink by magnetic attraction between the faucet housing connector element and the sink connector element.

11. The faucet assembly of claim 10 wherein the outside pin arm is generally perpendicular to the inside pin arm.

12. The faucet assembly of claim 11 wherein the at least one valve conduit is disposed in the sleeve interior of the assembly retaining sleeve.

13. The faucet assembly of claim 10 wherein the plurality of pin openings comprises a plurality of spaced-apart pairs of pin openings arranged along the assembly base housing from the first housing end to the second housing end.

* * * * *